US011959659B2

(12) United States Patent
Oku et al.

(10) Patent No.: US 11,959,659 B2
(45) Date of Patent: Apr. 16, 2024

(54) OUTDOOR UNIT FOR AIR-CONDITIONING APPARATUS

(71) Applicant: Mitsubishi Electric Corporation, Tokyo (JP)

(72) Inventors: Kento Oku, Tokyo (JP); Keiichi Tomita, Tokyo (JP); Tetsuya Masuda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 909 days.

(21) Appl. No.: 16/971,844

(22) PCT Filed: Mar. 23, 2018

(86) PCT No.: PCT/JP2018/011616

§ 371 (c)(1),
(2) Date: Aug. 21, 2020

(87) PCT Pub. No.: WO2019/180902

PCT Pub. Date: Sep. 26, 2019

(65) Prior Publication Data

US 2021/0010712 A1 Jan. 14, 2021

(51) Int. Cl.
*F24F 13/20* (2006.01)
*F24F 13/22* (2006.01)
(Continued)

(52) U.S. Cl.
CPC ..... *F24F 13/20* (2013.01); *F24F 13/222* (2013.01); *F04B 39/121* (2013.01); *F04B 53/04* (2013.01)

(58) Field of Classification Search
CPC ..... F04B 39/00; F04B 53/00; F04B 39/121; F04B 39/0061; F04B 39/004; F04B 53/04;
(Continued)

(56) References Cited

U.S. PATENT DOCUMENTS 6,062,033 A 5/2000 Choi
2013/0133992 A1 5/2013 Harashima

FOREIGN PATENT DOCUMENTS

EP 2949934 A2 * 12/2015 ..... F04B 39/0033
EP 2949934 A2 12/2015
(Continued)

OTHER PUBLICATIONS

Extended European Search Report dated Feb. 24, 2020 in the corresponding EP application No. 18897866.2.
(Continued)

*Primary Examiner* — Harry E Arant
(74) *Attorney, Agent, or Firm* — POSZ LAW GROUP, PLC

(57) ABSTRACT

An outdoor unit for an air-conditioning apparatus, having a compressor, a top cover configured to cover an upper surface of the compressor, and a side cover configured to cover a side of the compressor and a side of the top cover, the side cover including a rectangular cutout portion formed in a part of an upper end of the side cover. The outdoor unit has a non-water-absorbent draining element disposed across from a central portion of the top cover to a bottom portion of the cutout portion, and tilts down from the central portion of the top cover toward the bottom portion of the cutout portion.

14 Claims, 16 Drawing Sheets

(51) Int. Cl.
*F04B 39/12* (2006.01)
*F04B 53/04* (2006.01)

(58) Field of Classification Search
CPC ..... F04B 39/0033; F24F 13/22; F24F 13/20; F24F 13/222; F24F 1/12; F24F 13/24
See application file for complete search history.

(56) References Cited

FOREIGN PATENT DOCUMENTS

| | | | | |
|---|---|---|---|---|
| JP | S59113182 | U | * | 7/1984 |
| JP | H11-281098 | A | | 10/1999 |
| JP | 2000-130801 | A | | 5/2000 |
| JP | 2008-275251 | A | | 11/2008 |
| JP | 2015-187507 | A | | 10/2015 |
| JP | 2015-224224 | A | | 12/2015 |

OTHER PUBLICATIONS

International Search Report of the International Searching Authority dated May 22, 2018 for the corresponding international application No. PCT/JP2018/011616 (and English translation).

* cited by examiner

OUTDOOR UNIT FOR AIR-CONDITIONING APPARATUS

CROSS REFERENCE TO RELATED APPLICATIONS

This application is a U.S. national stage application of PCT/JP2018/011616 filed on Mar. 23, 2018, the contents of which are incorporated herein by reference.

TECHNICAL FIELD

The present invention relates to an outdoor unit for an air-conditioning apparatus, including a sound insulation element attached to a compressor.

BACKGROUND ART

An air-conditioning apparatus has a refrigerant circuit connected to an actuator such as a compressor via refrigerant pipes, and an outdoor unit including the compressor. In recent years, as for the outdoor unit, a heat exchanger and a fan have increased in size to improve a heat exchange capability. On the other hand, a main body of the outdoor unit has been reduced in size, for example, to save space. Consequently, in the main body of the outdoor unit, the refrigerant pipes are densely arranged in a narrow space. Thus, the number of refrigerant pipes arranged above the compressor increases.

Meanwhile, in the outdoor unit, noise is generated from the compressor due to operations of a motor, a mechanism and the other components of the compressor. To solve the problem, heretofore, a sound insulation element made of felt is attached as a noise countermeasure to a periphery of the compressor (e.g., see Patent Literature 1).

CITATION LIST

Patent Literature

Patent Literature 1: Japanese Unexamined Patent Application Publication No. 1999-281098

SUMMARY OF INVENTION

Technical Problem

However, in an outdoor unit, when condensed dew is generated, for example, on the surface of a refrigerant pipe, the generated dew flows down, as condensed water, along the refrigerant pipe and others. Therefore, in the outdoor unit described in Patent Literature 1, the condensed water drops down from a bent portion in the refrigerant pipe above the compressor to an upper surface of a sound insulation element. Then, the condensed water dropped downward penetrates into the sound insulation element made of felt, is held in the insulation element without being evaporated. Consequently, for example, a thermistor disposed in an upper portion of the compressor is wet with water or is submerged in water, and false detection is caused. Furthermore, the refrigerant leaks through holes made due to rust of a main body of the compressor.

The present invention has been attained to solve such problems as described above, and an object thereof is to provide an outdoor unit for an air-conditioning apparatus capable of preventing condensed water from penetrating into a portion of felt of a sound insulation element.

Solution to Problem

According to one embodiment of the present invention, an outdoor unit for an air-conditioning apparatus has a compressor, a top cover configured to cover an upper surface of the compressor, a side cover configured to cover a side of the compressor and a side of the top cover, the side cover including a cutout portion formed in a part of an upper end of the side cover, and a non-water-absorbent draining element disposed across from a central portion of the top cover to a bottom portion of the cutout portion, and tilts down from the central portion of the top cover toward a bottom portion of the cutout portion.

Advantageous Effects of Invention

According to one embodiment of the present invention, an outdoor unit has a non-water-absorbent draining element tilting down from a central portion of a top cover toward a bottom portion of a cutout portion, as a sound insulation element together with a top cover and a side cover. Therefore, when condensed water drops down from a refrigerant pipe above a compressor, the water can pass along an upper surface of the draining element, to be drained. Consequently, it is possible to prevent the condensed water from penetrating into a felt portion of the sound insulation element.

DESCRIPTION OF EMBODIMENTS

Embodiment 1

Figure 1:
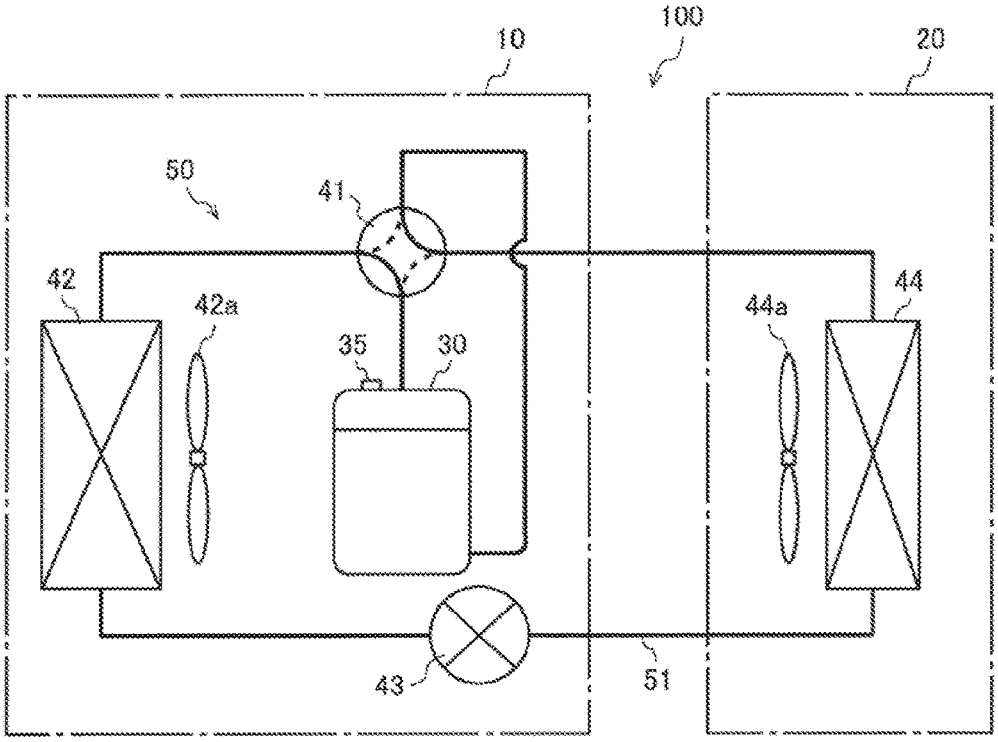
FIG. 1 is a schematic configuration diagram illustrating a refrigerant circuit of an air-conditioning apparatus according to Embodiment 1 of the present invention.

FIG. 1 is a schematic configuration diagram illustrating a refrigerant circuit of an air-conditioning apparatus according to Embodiment 1. As shown in FIG. 1, an air-conditioning apparatus 100 has an outdoor unit 10 installed outdoors and an indoor unit 20 installed indoors. The outdoor unit 10 and the indoor unit 20 are connected by a refrigerant pipe 51.

The outdoor unit 10 has a compressor 30, a four-way valve 41, an outdoor heat exchanger 42, and an expansion valve 43. The compressor 30 is driven, for example, by an inverter, and compresses refrigerant. The four-way valve 41 is connected to a discharge side of the compressor 30, and switches a flow path of the refrigerant. The four-way valve 41 is switched, for example, to the flow path shown by a solid line in FIG. 1 during a cooling operation and during a defrosting operation, and is switched to a flow path shown by a broken line of FIG. 1 during a heating operation. The outdoor heat exchanger 42 comprises, for example, a fin and tube heat exchanger, and exchanges heat between outside air and the refrigerant. The expansion valve 43 comprises, for example, an electronic expansion valve, and decompresses and expands the refrigerant.

The indoor unit 20 has an indoor heat exchanger 44 comprising, for example, a fin and tube heat exchanger and exchanges heat between indoor air and the refrigerant. That is, the air-conditioning apparatus 100 has a refrigerant circuit 50 formed so that the compressor 30, the four-way valve 41, the outdoor heat exchanger 42, the expansion valve 43 and the indoor heat exchanger 44 are connected by the refrigerant pipe 51.

Furthermore, the outdoor unit 10 has an outdoor fan 42*a* attached to the outdoor heat exchanger 42 to send air to the outdoor heat exchanger 42, and a shell temperature sensor 35 disposed on an upper portion of a shell 30*a* of the compressor 30 to detect a temperature of the shell 30*a* of the compressor 30. The indoor unit 20 has an indoor fan 44*a* attached to the indoor heat exchanger 44 to send air to the indoor heat exchanger 44.

Figure 2:
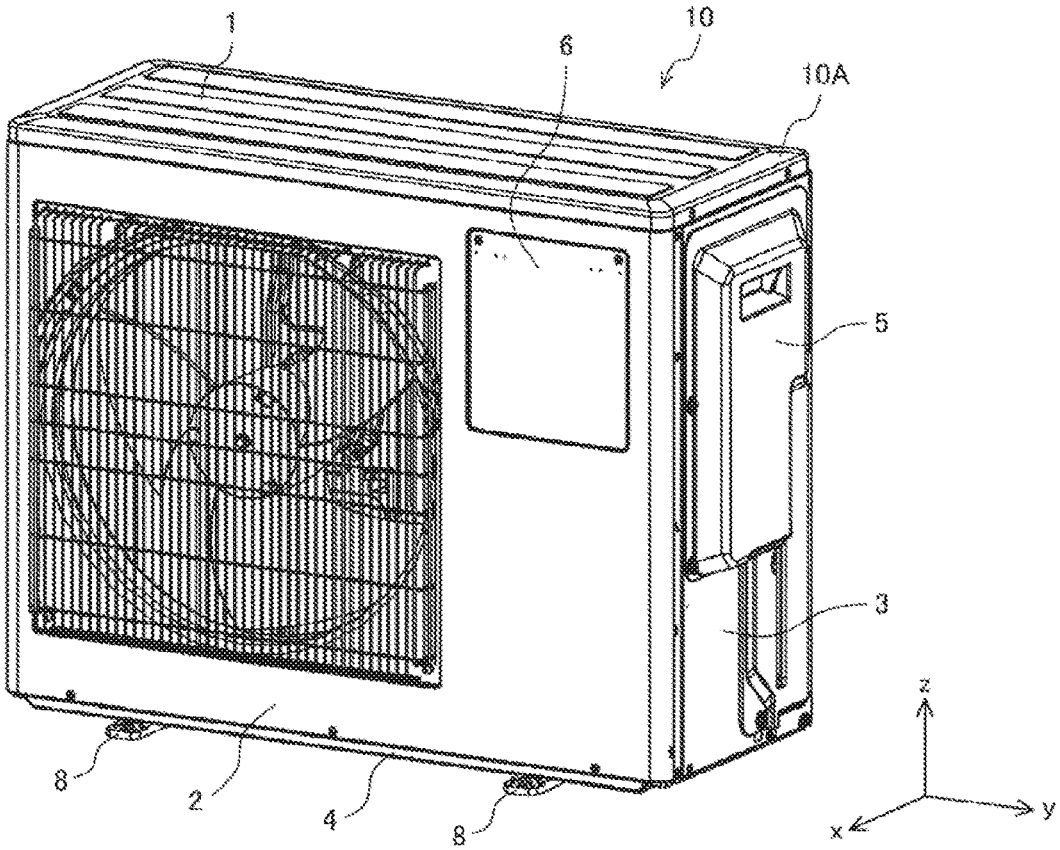
FIG. 2 is a perspective view illustrating an appearance of an outdoor unit of FIG. 1.
Figure 3:
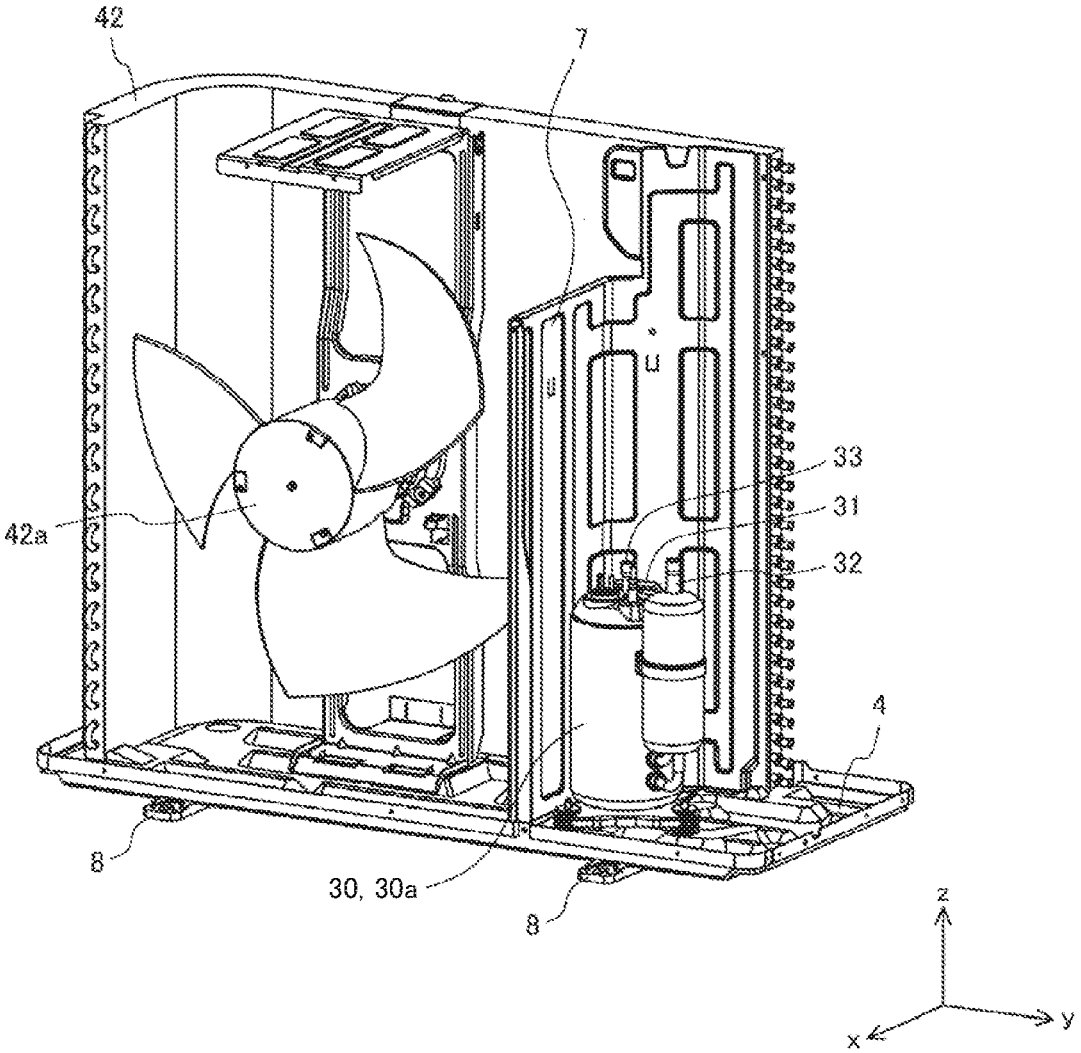
FIG. 3 is a perspective view illustrating excerpted interior parts of the outdoor unit of FIG. 1.

FIG. 2 is a perspective view illustrating an appearance of the outdoor unit of FIG. 1. FIG. 3 is a perspective view illustrating excerpted interior parts of the outdoor unit of FIG. 1. In FIG. 2 and FIG. 3, a front-and-back direction of the outdoor unit 10 corresponds to an x-axis direction, a lateral direction of the outdoor unit 10 corresponds to a y-axis direction, and an up-and-down direction of the outdoor unit 10 corresponds to a z-axis direction. However, a structure, a direction or the like of the compressor 30 in FIG. 3 is only an example, and is not limited thereto. This also applies to the following drawings.

As shown in FIG. 2, the outdoor unit 10 has a box-like outdoor unit main body 10A, and the compressor 30, the four-way valve 41, the outdoor heat exchanger 42 and the expansion valve 43 are stored in the outdoor unit main body 10A. The outdoor unit main body 10A comprises a top panel 1, a front panel 2, a back panel 3, a bottom panel 4, a service panel 5, a sub panel 6, and a separator 7.

In the bottom panel 4, a drainage receiving portion is disposed at a position where condensed water W flowing down along a draining element 80 described later drops, and the drainage receiving portion leads to a drainage path. Furthermore, bases 8 supporting the outdoor unit main body 10A are disposed on an underside of the bottom panel 4. Note that FIG. 3 shows that the top panel 1, the front panel 2, the back panel 3, the service panel 5 and the sub panel 6 are removed, and the four-way valve 41, the expansion valve 43 and the refrigerant pipe 51 are not illustrated.

Figure 4:
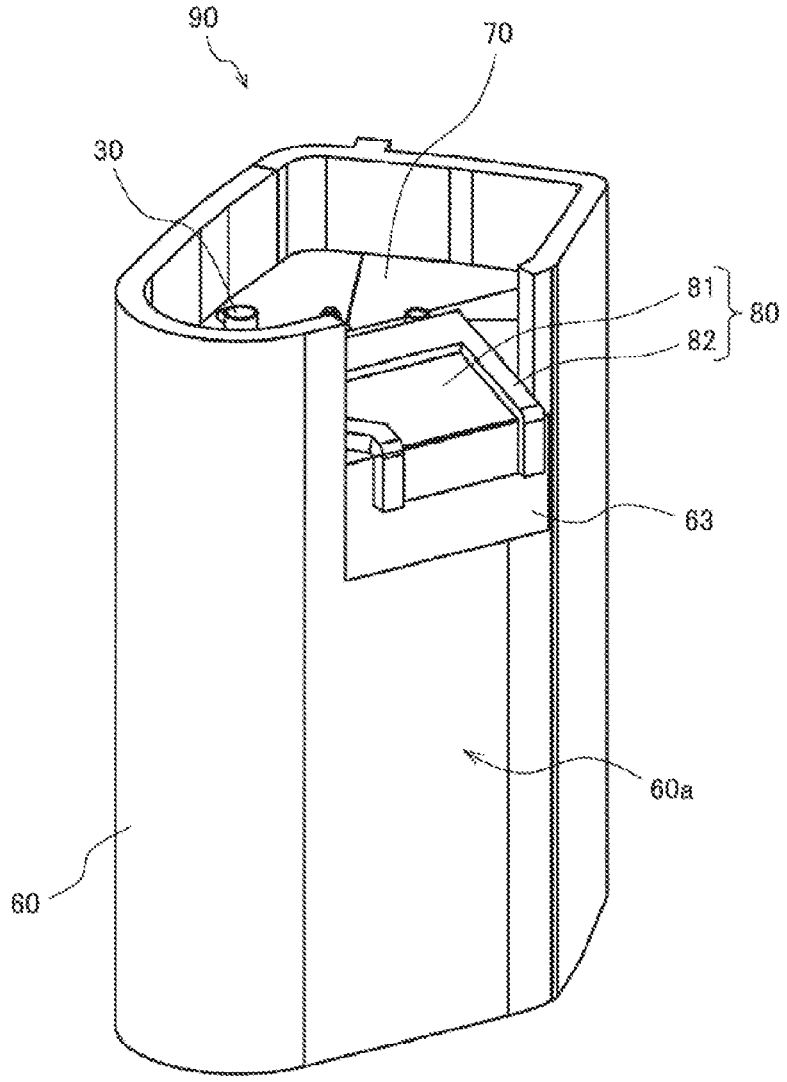
FIG. 4 is a perspective view showing that a sound insulation element is attached to a compressor of FIG. 3.

FIG. 4 is a perspective view showing that a sound insulation element is attached to the compressor of FIG. 3. As shown in FIG. 4, a sound insulation element 90 of Embodiment 1 comprises a side cover 60, a top cover 70, and a draining element 80. The top cover 70 comprises a sheet made of felt, and covers an upper surface of the compressor 30. The side cover 60 comprises a sheet made of felt, and covers a side of the compressor 30 and a side of the top cover 70. The draining element 80 is made of a non-water-absorbent material so as to repel water.

Figure 5:
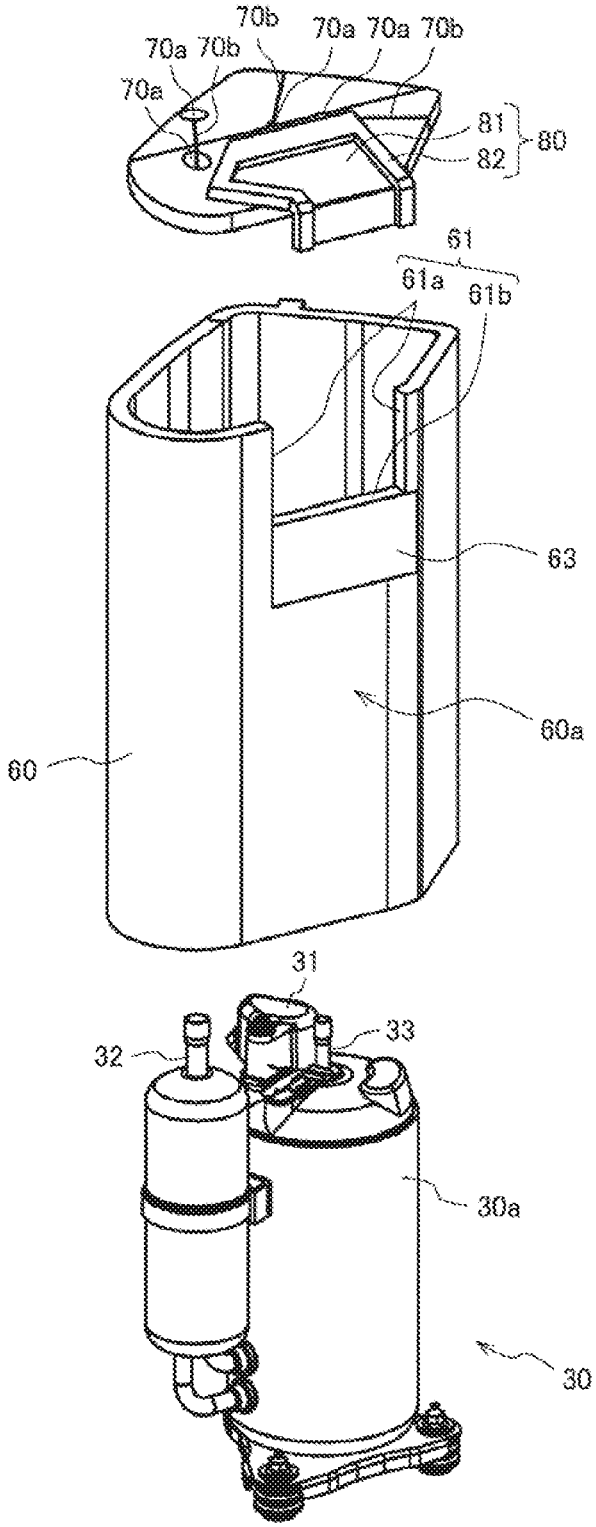
FIG. 5 is an exploded perspective view showing a positional relation between the compressor and the sound insulation element in FIG. 4.
Figure 6:
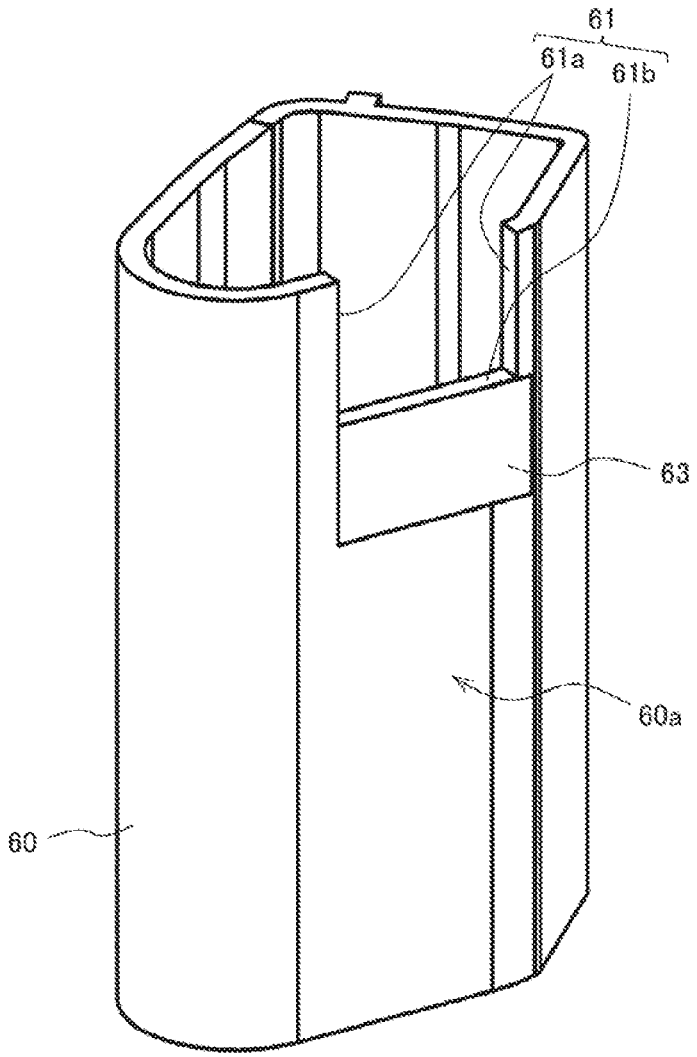
FIG. 6 is a perspective view showing a side cover of FIG. 5.
Figure 7:
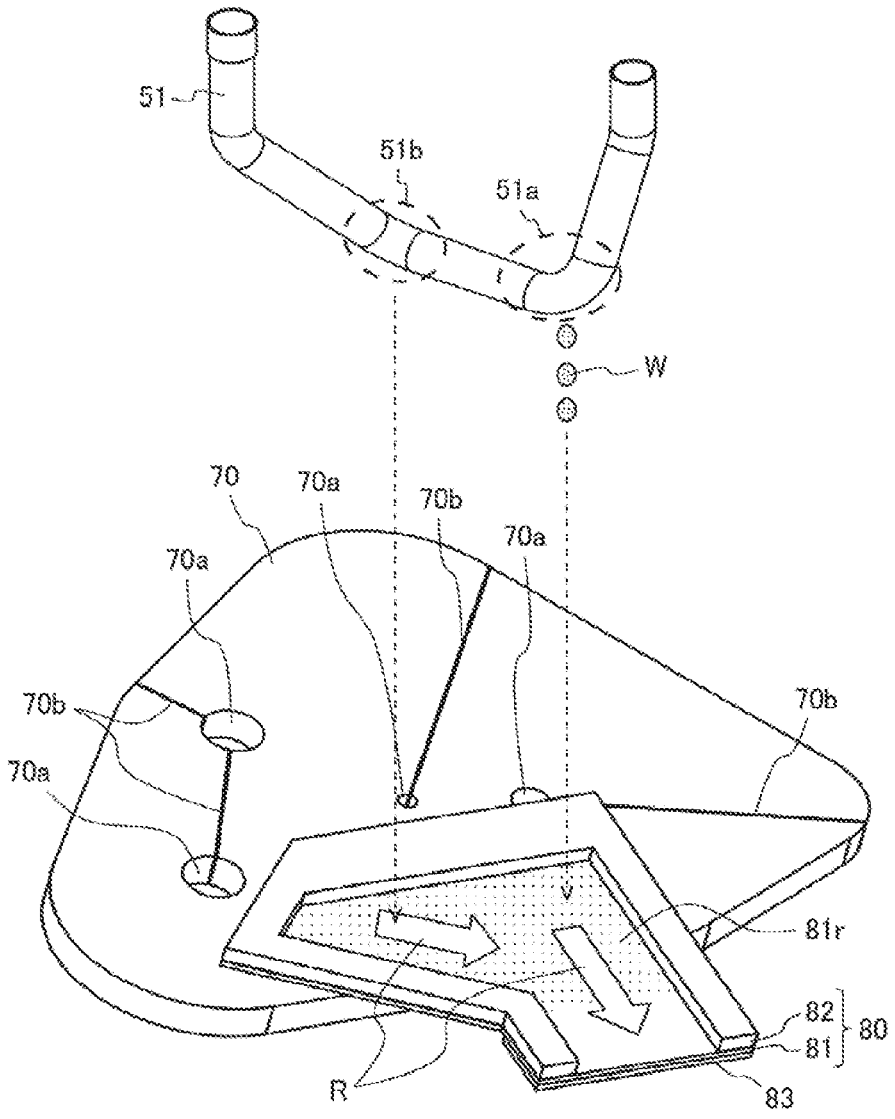
FIG. 7 is a perspective view for explanation of a relation between a draining element of FIG. 5 and a peripheral configuration of the element.
Figure 8:
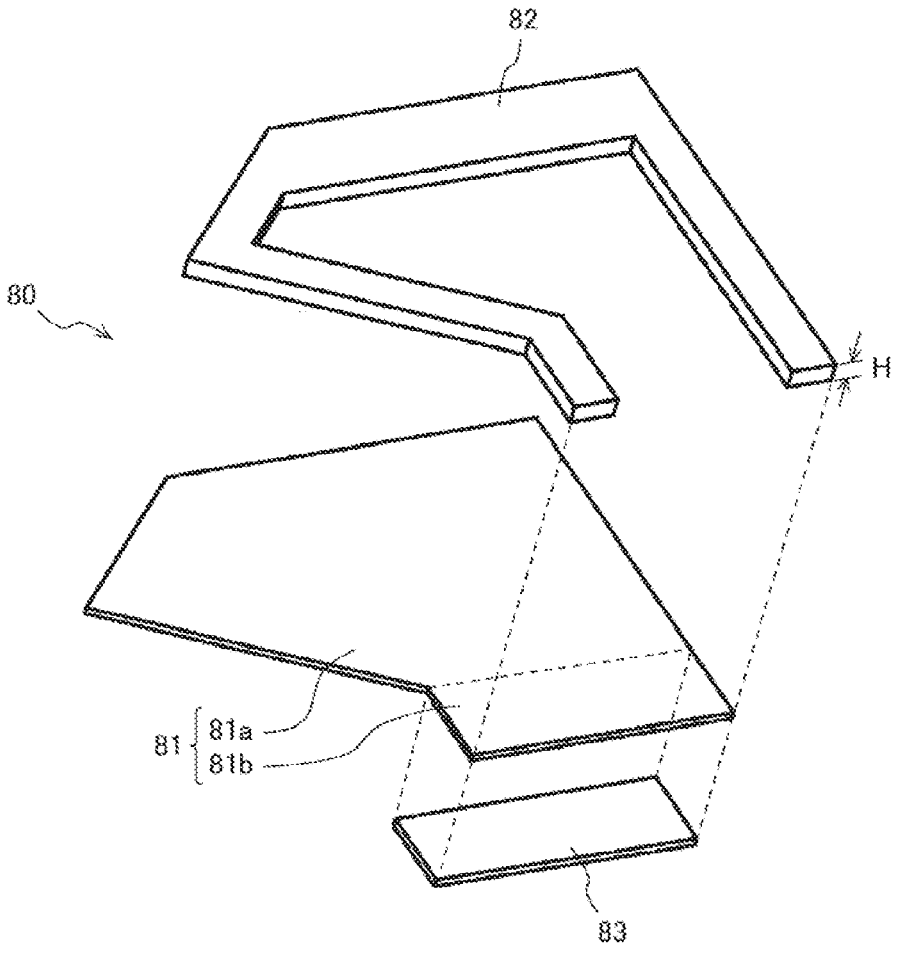
FIG. 8 is an exploded perspective view for explanation of a structure of the draining element of FIG. 7.

FIG. 5 is an exploded perspective view showing a positional relationship between the compressor and the sound insulation element in FIG. 4. FIG. 6 is a perspective view showing the side cover of FIG. 5. FIG. 7 is a perspective view for explanation of a relation between the draining element of FIG. 5 and a peripheral configuration of the element. FIG. 8 is an exploded perspective view explaining a structure of the draining element of FIG. 7. Specific configuration of the sound insulation element 90 will be described with reference to FIG. 5 to FIG. 8.

As shown in FIG. 5, a terminal cover 31 configured to cover a terminal and others is disposed on the upper surface of the compressor 30. The terminal cover 31 protrudes upward from the upper surface of the compressor 30. On the upper surface of the compressor 30, there are disposed protruding components such as a suction pipe 32 suctioning the refrigerant and a discharge pipe 33 discharging the refrigerant. Note that the suction pipe 32 and the discharge pipe 33 are each connected to the refrigerant pipe 51.

In the top cover 70, insertion holes 70*a* are disposed so that protruding components such as the suction pipe 32 and the discharge pipe 33 are inserted into the insertion holes. Furthermore, each of cuts 70*b* is disposed, for example, between a periphery and each of the insertion holes 70*a* to facilitate the insertion of the suction pipe 32, the discharge pipe 33 or the other protruding components in the top cover 70.

As shown also in FIG. 6, a rectangular cutout portion 61 is formed in a part of an upper end of the side cover 60. The cutout portion 61 comprises two cut portions 61*a* along the up-and-down direction and a bottom portion 61*b* connecting lower ends of the two cut portions 61*a* to each other. That is, the side cover 60 has an annular upper end portion including the cutout portion 61.

A side fixing element 63 to be fixed to the draining element 80 is disposed in an outer peripheral surface 60*a* of the side cover 60. In Embodiment 1, a hook-and-loop fastener is adopted as the side fixing element 63, and the side fixing element 63 is sewn, with thread or the like, to the vicinity of the bottom portion 61*b* in the outer peripheral surface 60*a*. As shown in FIG. 5, the side fixing element 63 may be continuously attached to the bottom portion 61*b*, or may be attached to a portion being away for a predetermined distance from the bottom portion 61*b*. However, the side fixing element 63 may be attached to the outer peripheral surface 60*a* by use of, for example, a double-sided adhesive tape or an adhesive, as long as sufficient fixing strength can be secured.

The draining element 80 is disposed across from a central portion of the top cover 70 to the bottom portion 61*b* of the cutout portion 61. The draining element 80 is attached to the top cover 70 and the side cover 60 so as to tilt down from the central portion of the top cover 70 toward the bottom portion of the cutout portion 61.

As shown in FIG. 7 and FIG. 8, the draining element 80 has a sheet portion 81 disposed on an upper surface of the top cover 70, and a guide portion 82 disposed on a peripheral portion in an upper surface of the sheet portion 81 excluding the cutout portion 61. The sheet portion 81 is formed of a non-water-absorbent material such as rubber, and is disposed in a region where the condensed water W drops down.

The guide portion 82 is configured to discharge the condensed water W in an intended direction and is formed of a non-water-absorbent material such as a foam material. A guide height H of the guide portion 82 in an up-and-down direction is from about 5 mm to 10 mm. Furthermore, the guide portion 82 has a width of about 10 mm. In Embodiment 1, the width of a part of the guide portion opposite to the cutout portion 61 is larger than the width of the other part of the guide portion. However, the guide height H and the width of the guide portion 82 may be appropriately changed, for example, in accordance with a distance between the refrigerant pipe 51 above the compressor 30 and the sheet portion 81.

The sheet portion 81 has a base portion 81*a* fixed to the top cover 70 and a fixed portion 81*b* fixed to the outer peripheral surface 60*a* of the side cover 60. The base portion 81*a* is sewn to the top cover 70 with thread or the like. A shape of the base portion 81*a* is determined in accordance with a shape of the refrigerant pipe 51 disposed above the compressor 30. That is, in the refrigerant pipe 51, there are one or more bent portions bent downward, and the condensed water W flowing along the refrigerant pipe 51 drops down from the bent portions. Consequently, the sheet portion 81 is formed to include positions right under the bent portions of the refrigerant pipe 51 disposed above the compressor 30.

More specifically, a water receiving portion 81*r* inward of the guide portion 82 in the upper surface of the sheet portion 81 is formed and disposed to include the positions right under the bent portions of the refrigerant pipe 51. Consequently, drainage paths R of the condensed water W are formed in an upper portion of the draining element 80. According to Embodiment 1, the sheet portion 81 has the base portion 81*a* and the fixed portion 81*b*, and the water receiving portion 81*r* is a portion inward of the guide portion 82 in an upper surface of the base portion 81*a*.

FIG. 7 illustrates a bent portion 51*a* located at a lowermost position and a bent portion 51*b* located at a next lowermost position to the bent portion 51*a* as the bent portions formed in the refrigerant pipe 51 disposed above the compressor 30. When the refrigerant pipe 51 disposed above the compressor 30 is formed as shown in FIG. 7, this likely causes the condensed water W to drop down from the bent portion 51*a*, and also causes the condensed water W to drop down from the bent portion 51*b*. Therefore, on the upper surface of the base portion 81*a* of the sheet portion 81, the water receiving portion 81*r* surrounded by the guide portion 82 (refer to a dotted portion of FIG. 7) is formed to include the position right under the bent portion 51*a* and the position right under the bent portion 51*b*. Therefore, the condensed water W dropped down from the refrigerant pipe 51 passes the drainage paths R (see white arrows of FIG. 7) on the draining element 80, flows to the drainage receiving portion of the bottom panel 4 and is discharged to the outside via the drainage path of the bottom panel.

A draining side fixing element 83 comprising a hook-and-loop fastener is attached to at least a part of a lower surface of the fixed portion 81*b*. Here, in the side cover 60, the side fixing element 63 is disposed in a region facing the lower surface of the fixed portion 81*b* in the outer peripheral surface 60*a*, and the draining side fixing element 83 is affixed to the side fixing element 63. The draining side fixing element 83 is sewn to the fixed portion 81*b* with thread or the like. However, the draining side fixing element 83 may be fixed to the fixed portion 81*b* by use of, for example, a double-sided adhesive tape or an adhesive, as long as sufficient fixing strength can be secured.

Here, the sheet portion 81 and the guide portion 82 are affixed by the double-sided adhesive tape. However, the sheet portion 81 and the guide portion 82 may be affixed together by use of the adhesive or the like, as long as water resistance and fixing strength can be secured. The sheet portion 81 and the guide portion 82 may be integrally sewn to the top cover 70 with thread or the like. In this case, the part of the guide portion 82 opposite to the cutout portion 61 may be only sewn integrally with the sheet portion 81 to the top cover 70, and the other part of the guide portion may be affixed to the sheet portion 81 only by use of the double-sided adhesive tape or the adhesive.

Figure 9:
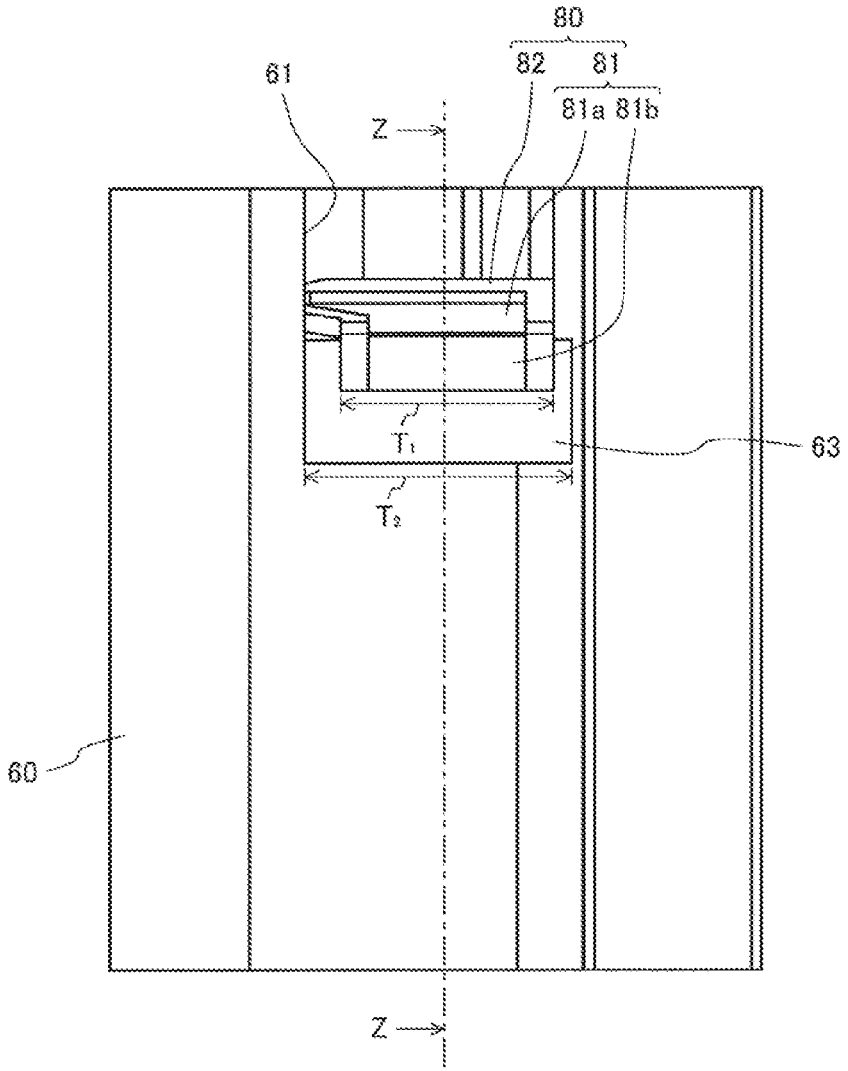
FIG. 9 is a side view of the compressor and the sound insulation element of FIG. 4 as viewed from a cutout portion.
Figure 10:
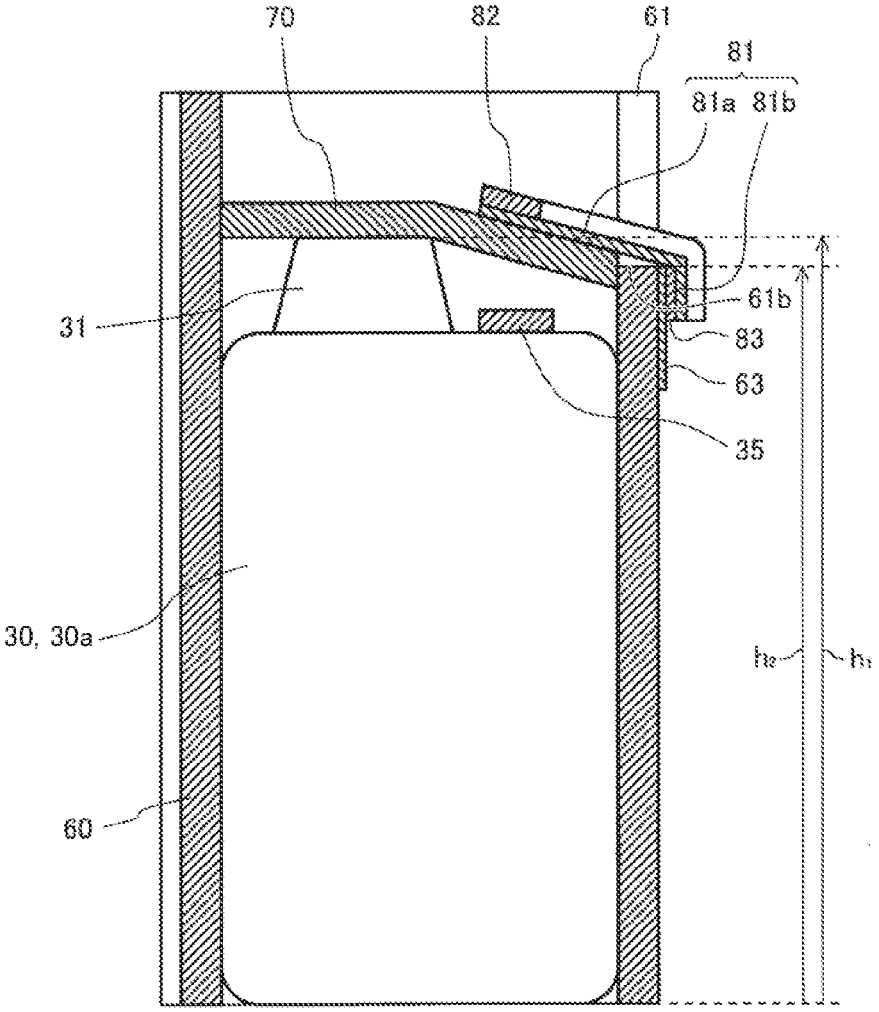
FIG. 10 is a schematic sectional view taken along a Z-Z line of FIG. 9.

FIG. 9 is a side view of the compressor and the sound insulation element of FIG. 4 showing a cutout portion. FIG. 10 is a schematic sectional view taken along a Z-Z line of FIG. 9. A configuration associated with tilt of the draining element 80 will be described with reference to FIG. 9 and FIG. 10.

As shown in FIG. 9, a width $T_1$ of the base portion 81*a* in a lateral direction is shorter than a width $T_2$ of the side fixing element 63 in the lateral direction. However, it suffices that the width $T_1$ of the base portion 81*a* in the lateral direction be equal to or less than the width $T_2$ of the side fixing element 63 in the lateral direction.

In the compressor 30 of Embodiment 1, when the suction pipe 32, the discharge pipe 33 and the other protruding components to be inserted into the insertion holes 70*a* are excluded, a height $h_1$ of the highest portion of the terminal cover 31 is maximum as shown in FIG. 10. Then, a height $h_2$ of the bottom portion 61*b* lowest in the cutout portion 61 is lower than the height $h_1$ of the terminal cover 31. Here, the cutout portion 61 is disposed opposite to the terminal cover 31 relative to the central portion of the top cover 70, that is, a central portion of the compressor 30. Furthermore, since the draining element 80 is attached to the top cover 70, the draining element 80 is disposed integrally with the top cover 70.

In such an arrangement and configuration as described above, the fixed portion 81*b* is fixed to the side cover 60 in a state where the top cover 70 is placed on the terminal cover 31 and the base portion 81*a* of the draining element 80 is in contact with the bottom portion 61*b* of the cutout portion 61. Then, due to a height difference ($h_1$-$h_2$) between the height $h_1$ of the terminal cover 31 and the height $h_2$ of the bottom portion 61*b*, the draining element 80 is inclined from the central portion of the compressor 30 toward the outside. That is, the draining element 80 is configured to tilt down from the central portion of the top cover 70 toward the bottom portion 61*b*. Note that the height difference ($h_1$-$h_2$) between the height $h_1$ of the terminal cover 31 and the height $h_2$ of the bottom portion 61*b* may be set to 5 mm or more.

As described above, the sound insulation element 90 of Embodiment 1 has the non-water-absorbent draining element 80 tilting down from the central portion of the top cover 70 toward the bottom portion 61*b* of the cutout portion 61, together with the side cover 60 and the top cover 70. Consequently, when the condensed water W drops down from the refrigerant pipe 51 disposed above the compressor 30, the water can pass along an upper surface of the draining element 80 to be drained, and hence the condensed water W can be prevented from penetrating into a portion of felt of the sound insulation element 90. Therefore, the shell temperature sensor 35 disposed on an upper portion of the compressor 30 can be prevented from being wet with water or being submerged in water, so that false detection of the shell temperature sensor 35 can be inhibited. In addition, the compressor main body including the shell 30*a* can be inhibited from rusting, so that the refrigerant can be prevented from leaking through holes made due to the rust in the compressor main body.

Furthermore, the draining element 80 comprises the sheet portion 81 and the guide portion 82. Therefore, the condensed water W dropped down to the sheet portion 81 is regulated to flow inwardly by the guide portion 82, so that the condensed water W dropped down to the sheet portion 81 can be more securely prevented from flowing to the top cover 70 and the side cover 60. However, the draining element 80 may comprise only the sheet portion 81. Also in this case, since the sheet portion 81 is made of the non-water-absorbent material and tilts down from the central portion of the top cover 70 toward the bottom portion 61*b*, the condensed water W can be prevented from penetrating into the top cover 70 and the side cover 60.

Additionally, the sheet portion 81 comprises the base portion 81*a* and the fixed portion 81*b*, and the surface of the fixed portion 81*b* is disposed outwardly from the outer peripheral surface 60*a* of the side cover 60. Therefore, the condensed water W flowing along the fixed portion 81*b* drops down to the bottom panel 4 outwardly from the outer peripheral surface 60*a*, so that the condensed water W can be more securely prevented from penetrating into the side cover 60. However, the sheet portion 81 may comprise only the base portion 81*a*. Also in this case, since the draining element 80 tilts down from the central portion of the top cover 70 toward the bottom portion 61*b*, the condensed water W can drop down outwardly from the outer peripheral surface 60*a*, and the condensed water W can be prevented from penetrating into the side cover 60.

Furthermore, the draining side fixing element 83 is attached to at least a part of the lower surface of the fixed portion 81*b*. As for the side cover 60, the side fixing element 63 is attached to the region facing the lower surface of the fixed portion 81*b* in the outer peripheral surface 60*a*. Then, the draining side fixing element 83 and the side fixing element 63 are hook-and-loop fasteners that are repeatedly attachable and detachable and are affixed together. Therefore, the draining element 80 can be easily and stably attached to the side cover 60. Additionally, a position of the draining element 80 can be easily adjusted, and the draining element can be easily removed, so that it is possible to improve convenience.

In addition, the portion of the upper surface of the sheet portion 81 inward of the guide portion 82 is formed and disposed so as to include the position right under the bent portion of the refrigerant pipe 51 disposed above the compressor 30. Therefore, the condensed water W dropped down from the refrigerant pipe 51 drops down to the sheet portion 81 and is drained through the drainage path on the sheet portion 81, so that the condensed water W can be prevented from penetrating into the top cover 70 and the side cover 60.

Furthermore, the cutout portion 61 is disposed opposite to the terminal cover 31 relative to the central portion of the top cover 70, and the bottom portion 61*b* of the cutout portion 61 is formed at the position lower than an upper surface of the terminal cover 31. Therefore, when the sound insulation element 90 is only attached to the compressor 30, the draining element 80 can be easily inclined.

Additionally, in the sound insulation element 90 of Embodiment 1, the draining element 80 adopting such a structure as described above is attached to an upper portion of the top cover 70, so that the condensed water W can be prevented from dropping down to the top cover 70 and the side cover 60 including a felt sheet. In addition, the sound insulation element 90 covers the side of the compressor 30 with the side cover 60, and then covers the upper surface of the compressor 30 with the top cover 70 fixed to the draining element 80, thereby covering the whole compressor 30. Here, since the side cover 60 and the top cover 70 comprise the felt sheet, noise of the compressor 30 can be reduced. That is, according to the sound insulation element 90 and the outdoor unit 10 of Embodiment 1, while a function of suppressing the noise of the compressor 30 is maintained, the condensed water W dropping down from a portion above the compressor 30 can be drained without penetrating into a portion of felt of the sound insulation element 90.

Meanwhile, it has been illustrated above with reference to each drawing that the cutout portion 61 is rectangular, but the shape of the cutout portion is not limited thereto. For example, the shape of the cutout portion 61 may be formed in another shape such as a trapezoidal shape by cutting and forming at least one of the two cut portions 61*a* obliquely relative to the up-and-down direction. Furthermore, the middle of each cutout portion 61*a* may be tilted at different angles or may be curved.

Figure 11:
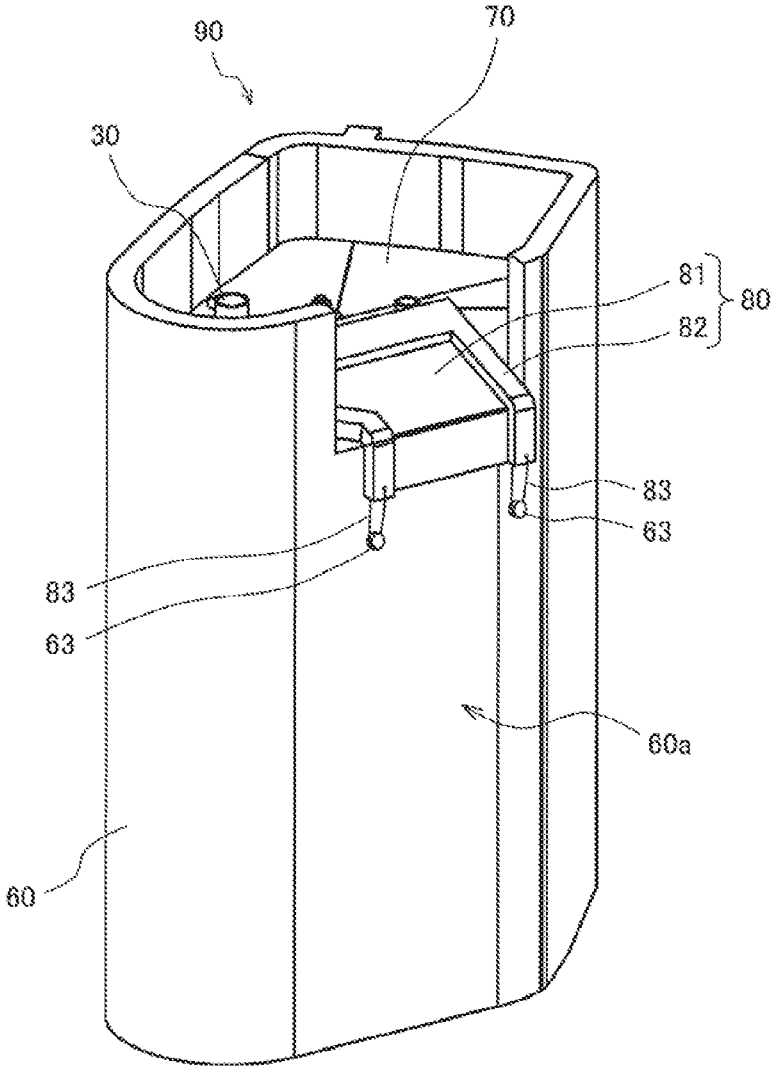
FIG. 11 is a perspective view showing that another sound insulation element is attached to the compressor of FIG. 3.

Additionally, it has been illustrated above that the side fixing element 63 and the draining side fixing element 83 are the hook-and-loop fasteners corresponding to each other, but the elements are not limited to this example. For example, the side fixing element 63 and the draining side fixing element 83 may be one or more sets of hooks corresponding to each other. Here, FIG. 11 is a perspective view showing that another sound insulation element is attached to the compressor of FIG. 3. That is, the side fixing element 63 may be such a button-like or hook-like protrusion as shown in FIG. 11. In this case, as shown in FIG. 11, the draining side fixing elements 83 may be string elements disposed at ends of the guide portion 82 in the cutout portion 61 to be hooked on the side fixing elements 63. According to such an adopted configuration, also when the sheet portion 81 does not include the fixed portion 81*b*, the draining element 80 can be easily and stably attached to the side cover 60.

Embodiment 2

An overall configuration of an air-conditioning apparatus in Embodiment 2 is similar to Embodiment 1 described above. That is, overall configurations of a refrigerant circuit and an outdoor unit in the air-conditioning apparatus of Embodiment 2 are similar to the configurations of the example of FIG. 1 to FIG. 3. Therefore, constituting elements equivalent to the elements of Embodiment 1 are denoted with the same reference signs and description is omitted.

Figure 12:
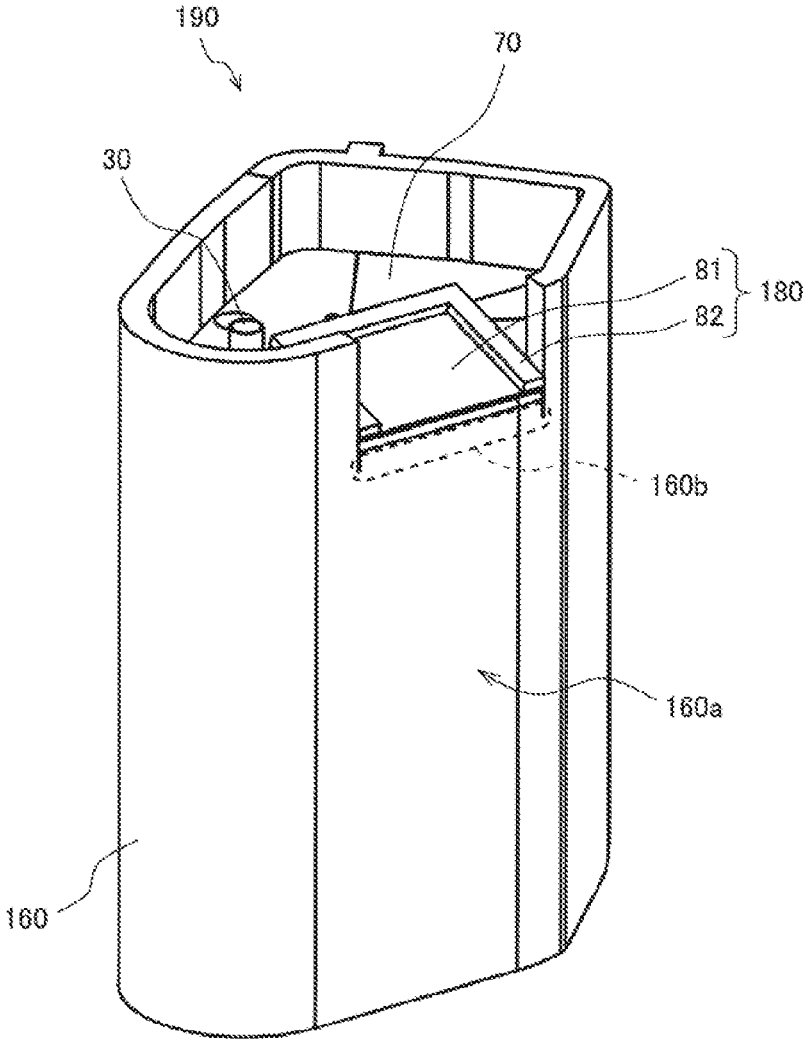
FIG. 12 is a perspective view showing that a sound insulation element is attached to a compressor in an outdoor unit for an air-conditioning apparatus according to Embodiment 2 of the present invention.

FIG. 12 is a perspective view showing that a sound insulation element is attached to a compressor in the outdoor unit for the air-conditioning apparatus according to Embodiment 2. As shown in FIG. 12, a sound insulation element 190 of Embodiment 2 comprises a side cover 160, a top cover 70, and a draining element 180. The side cover 160 is made of a felt sheet, and covers a side of a compressor 30 and a side of the top cover 70. The draining element 180 is made of a non-water-absorbent material to repel water.

Figure 13:
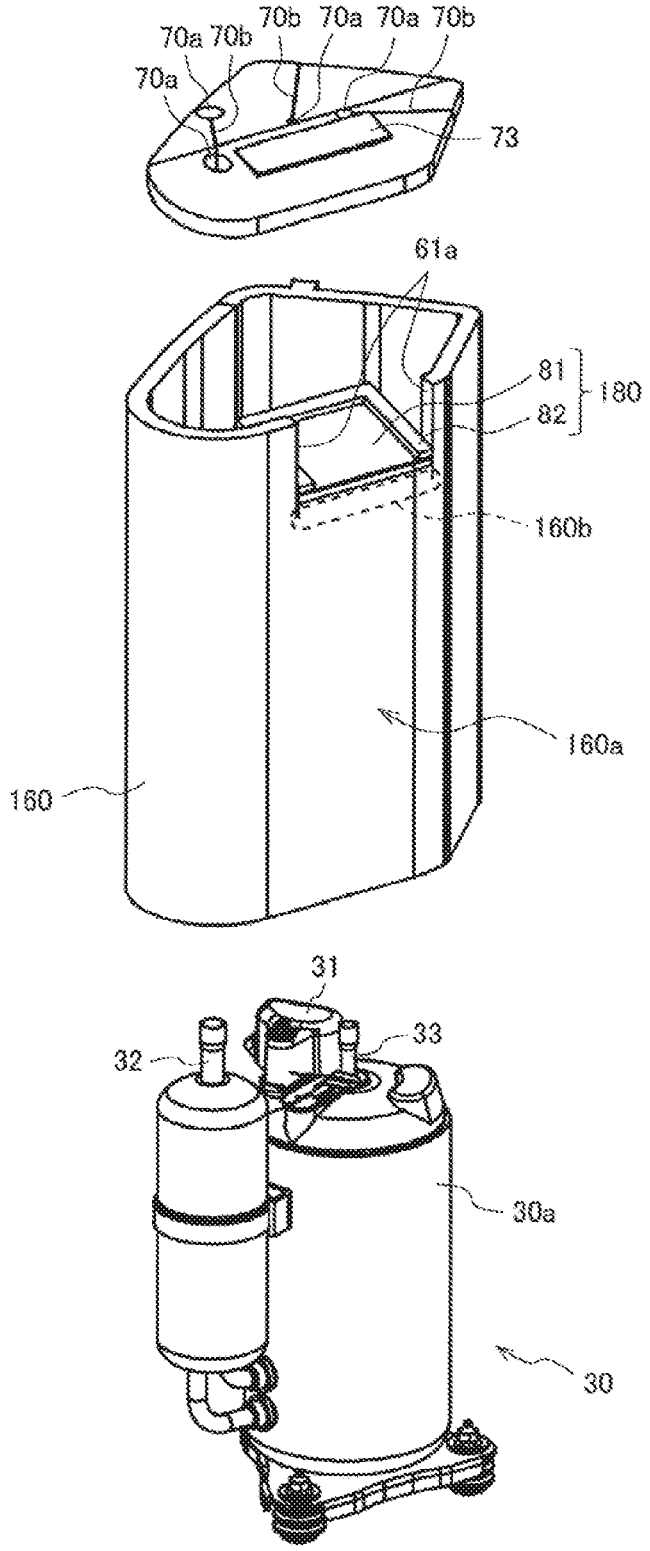
FIG. 13 is an exploded perspective view showing a positional relation between the sound insulation element and the compressor of FIG. 12.
Figure 14:
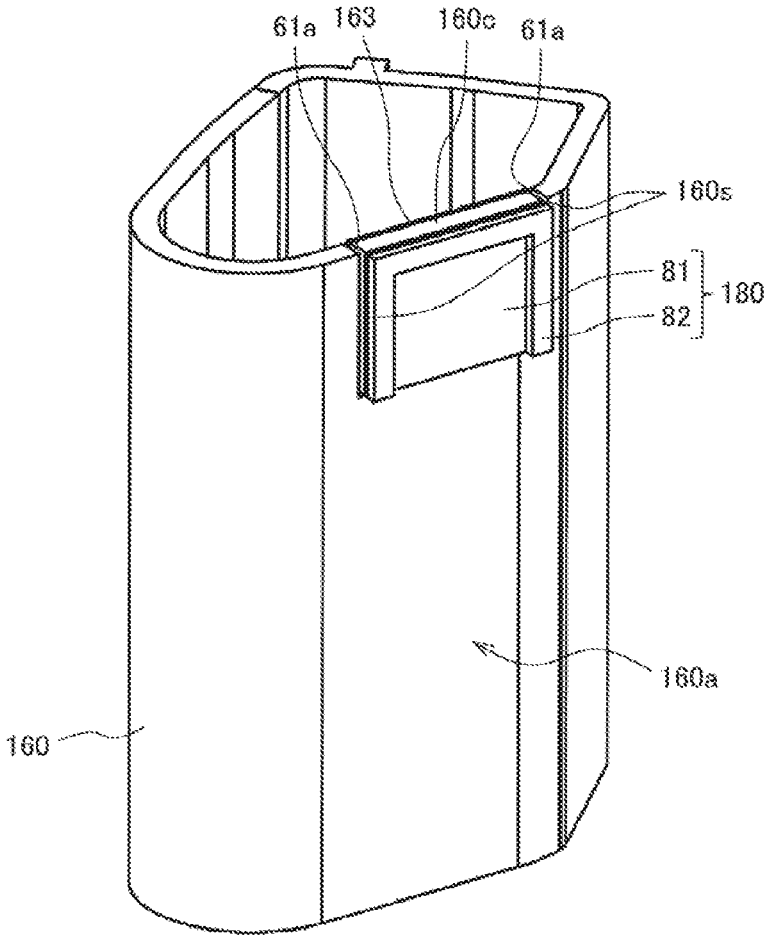
FIG. 14 is a perspective view showing a side cover and a draining element of FIG. 13.
Figure 15:
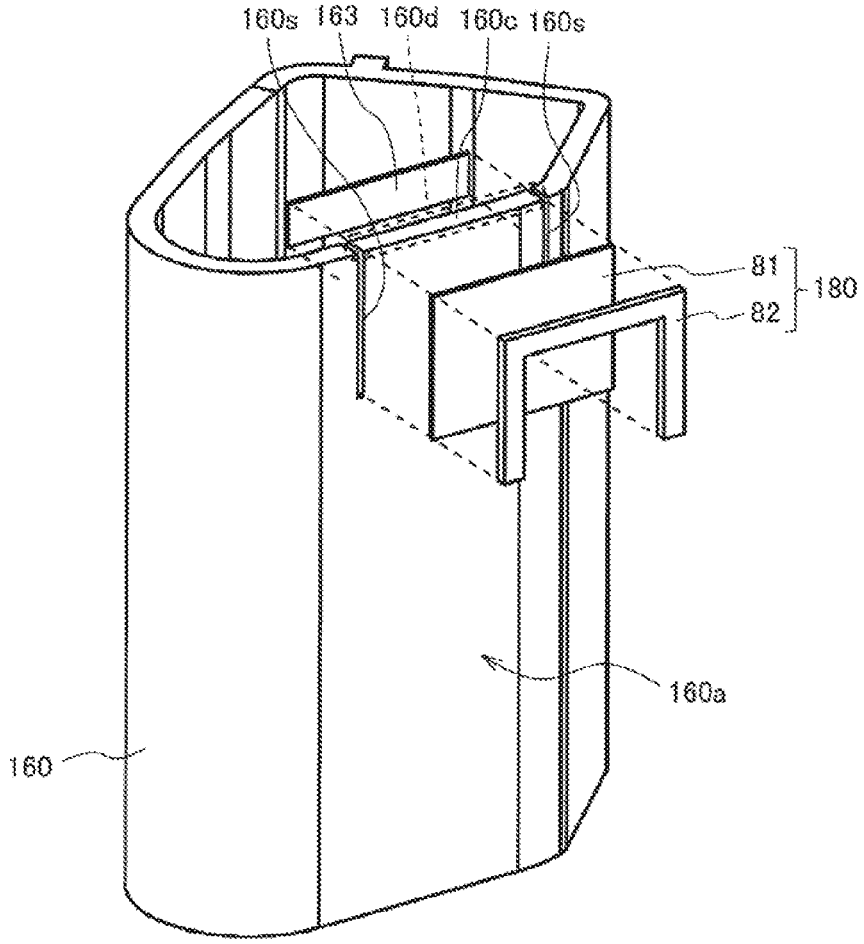
FIG. 15 is an exploded perspective view explaining a structure of the draining element of FIG. 14.
Figure 16:
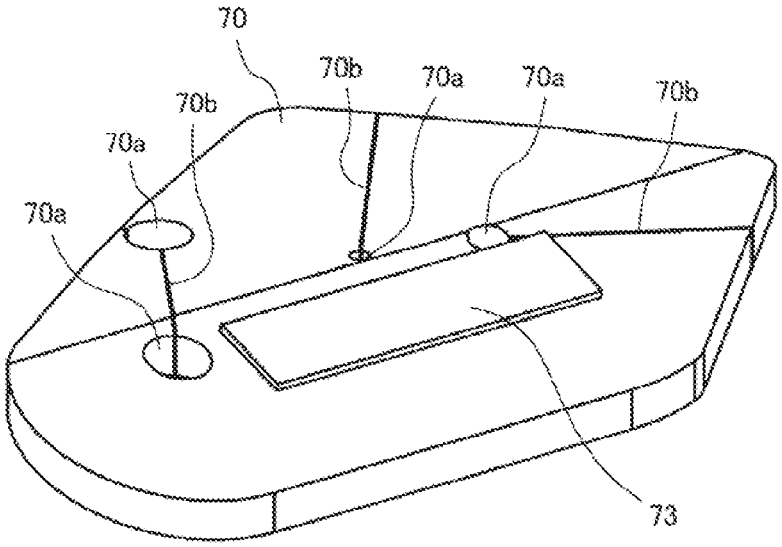
FIG. 16 is a perspective view showing a top cover of FIG. 13.

FIG. 13 is an exploded perspective view showing a positional relation between the sound insulation element and the compressor of FIG. 12. FIG. 14 is a perspective view showing the side cover and the draining element of FIG. 13. FIG. 15 is an exploded perspective view for explanation of a structure of the draining element of FIG. 14. FIG. 16 is a perspective view showing the top cover of FIG. 13. A specific configuration of the sound insulation element 190 will be described with reference to FIG. 13 to FIG. 16.

In the side cover 160, two cuts are formed along an up-and-down direction in an upper end portion, and two cut portions 61*a* and a bottom portion 160*b* are formed as shown in FIG. 13. The bottom portion 160*b* is a portion where lower ends of the two cuts are connected to each other. The draining element 180 is a non-water-absorbent element disposed across from a central portion of the top cover 70 to the bottom portion 160*b* and tilts down from the central portion of the top cover 70 toward the bottom portion 160*b*. In Embodiment 2, the draining element 180 is an element disposed across from an upper portion 160*d* (see FIG. 15) connecting upper ends of the two cuts to each other to the bottom portion 160*b* and tilts down from the upper portion 160*d* toward the bottom portion 160*b*.

The side cover 160 has a suspending portion 160*c* disposed between the two cuts and bent inwardly in the bottom portion 160*b* to be superimposed on the top cover 70. The draining element 180 is disposed on an upper surface of the suspending portion 160*c*. That is, as shown in FIG. 14, slit portions 160*s* of slits are formed by two cuts of an upper end portion of the side cover 160. Then, the suspending portion 160*c* is bent inwardly from the bottom portion 160*b* as a starting point, and is placed on the top cover 70 as shown in FIG. 12. That is, the side cover 160 has an annular upper end portion including the suspending portion 160*c*.

As shown in FIG. 15, the draining element 180 has a sheet portion 81 disposed on the upper surface of the suspending portion 160*c*, and a guide portion 82 disposed in a periphery of an upper surface of the sheet portion 81 excluding the bottom portion 160*b*. The sheet portion 81 is disposed in a region where the condensed water W drops down. The sheet portion 81 of Embodiment 2 comprises only a portion corresponding to the base portion 81*a* of Embodiment 1.

Furthermore, in the suspending portion 160*c*, an inner surface fixing element 163 configured to fix the suspending portion 160*c* to the top cover 70 is attached to at least a part of an inner surface of the suspending portion. In Embodiment 2, a hook-and-loop fastener is adopted as the inner surface fixing element 163, and the inner surface fixing element 163 is sewn to the suspending portion 160*c* with thread or the like. However, the inner surface fixing element 163 may be attached to the suspending portion 160*c*, for example, by use of a double-sided adhesive tape or an adhesive, as long as sufficient fixing strength can be secured.

As shown in FIG. 16, the top cover 70 includes an upper surface fixing element 73 comprising a hook-and-loop fastener attached to a position facing the inner surface fixing element 163 in an upper surface of the top cover. That is, the inner surface fixing element 163 is affixed to the upper surface fixing element 73, whereby the draining element 180 is fixed to the top cover 70 via the suspending portion 160*c*. The upper surface fixing element 73 is sewn to the top cover 70 with thread or the like. However, the upper surface fixing element 73 may be fixed to the top cover 70, for example, by use of a double-sided adhesive tape or an adhesive, as long as sufficient fixing strength can be secured.

Here, also in Embodiment 2, a bent portion is formed above the compressor 30. Furthermore, the sheet portion 81 is formed and disposed so that a part of the sheet portion inward of the guide portion 82 in an upper surface of the sheet portion includes a position right under the bent portion of a refrigerant pipe 51.

Figure 17:
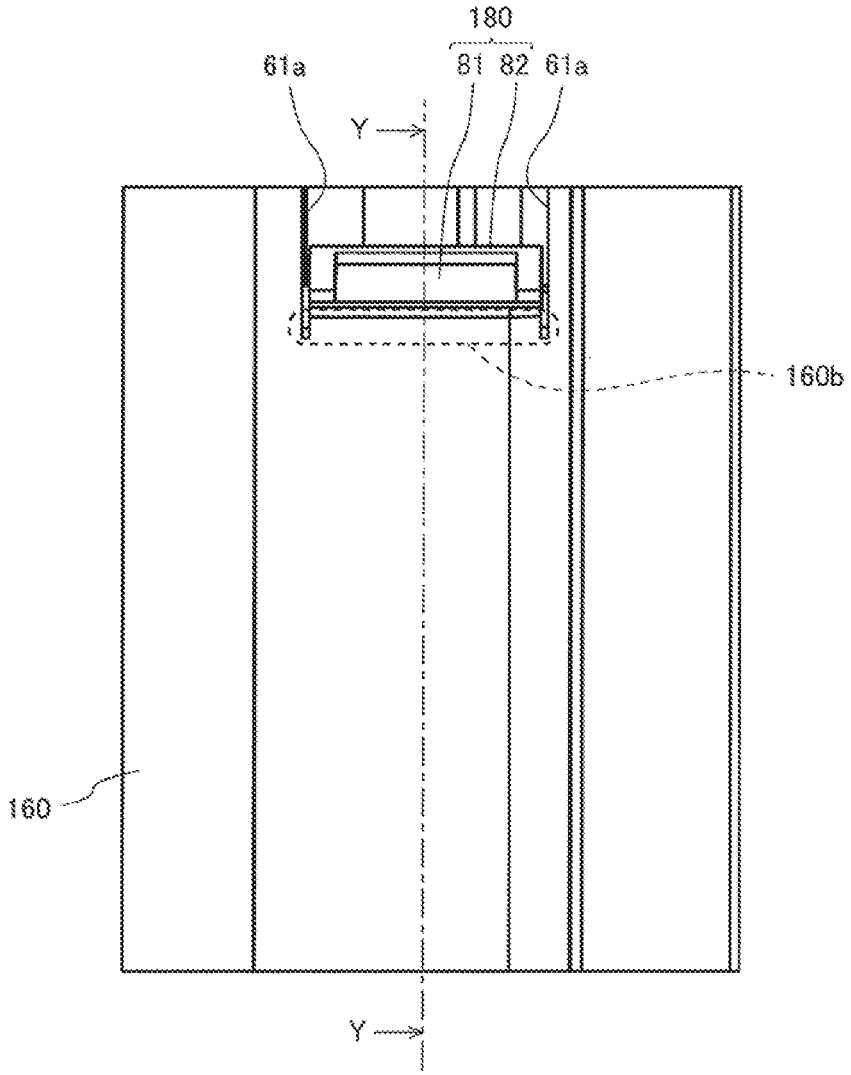
FIG. 17 is a side view of the compressor and the sound insulation element of FIG. 12 as viewed from two cuts.
Figure 18:
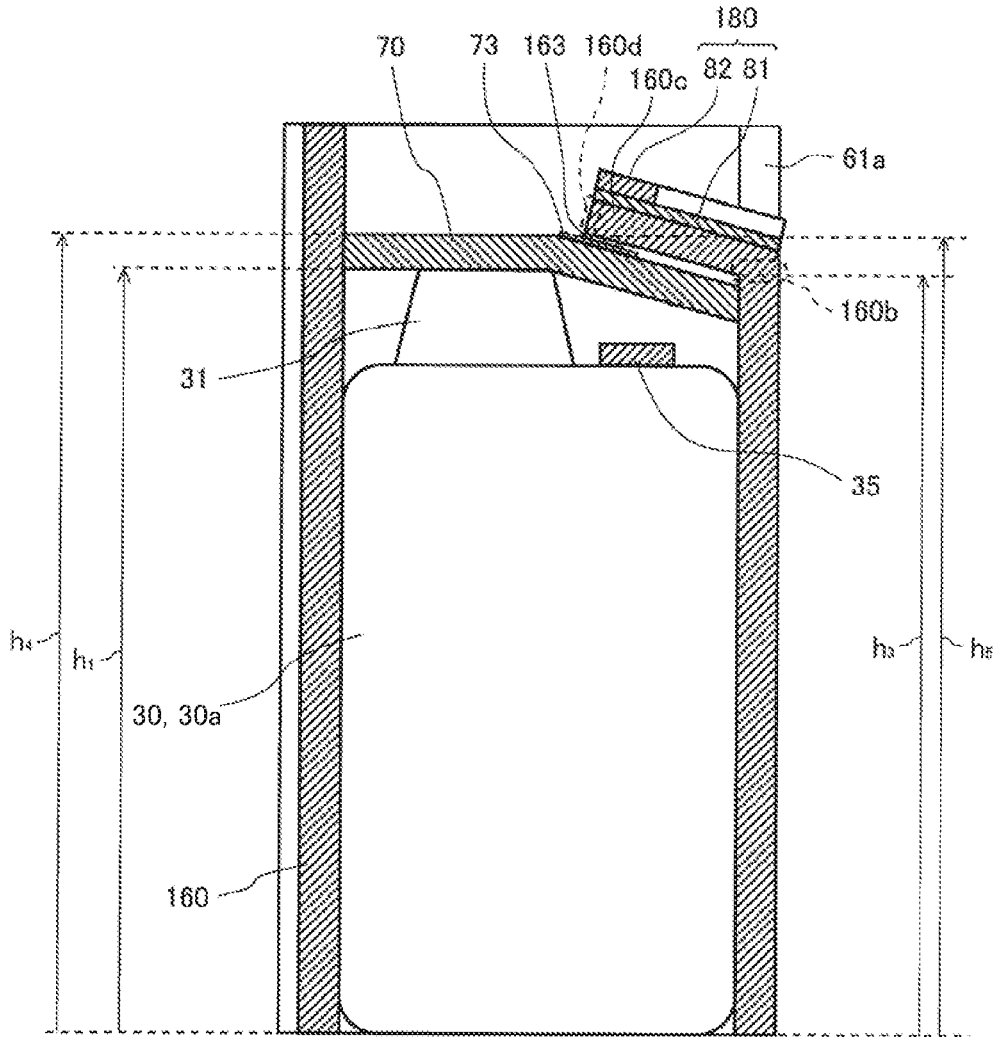
FIG. 18 is a schematic sectional view taken along a Y-Y line of FIG. 17.

FIG. 17 is a side view of the compressor and the sound insulation element of FIG. 12 as viewed from two cuts. FIG. 18 is a schematic sectional view taken along a Y-Y line of FIG. 17. A configuration associated with tilt of the draining element 180 will be described with reference to FIG. 17 and FIG. 18.

In the compressor 30 of Embodiment 2, when a suction pipe 32, a discharge pipe 33 and the other protruding components to be inserted into insertion holes 70*a* are excluded, a height $h_1$ of the highest portion of a terminal cover 31 is maximum as shown in FIG. 18. Then, a height $h_3$ of the bottom portion 160*b* is lower than a height ha of the top cover 70 located on an upper surface of the terminal cover 31. Here, the height $h_3$ of the bottom portion 160*b* corresponds to a height of a lowermost point of the slit portion 160*s*, that is, a height of a lowermost point of the cut portion 61*a*.

In Embodiment 2, as shown in FIG. 18, a height $h_5$ of the highest point of a part of the suspending portion 160*c* to be attached to the top cover 70 is higher than the height $h_3$ of the bottom portion 160*b*. That is, in each of the upper surface and a lower surface of the suspending portion 160*c*, a height of an upper end is lower than a height of a lower end. Therefore, when the top cover 70 is placed on the terminal cover 31 and the suspending portion 160*c* is placed on the top cover 70, the draining element 180 is inclined from a central portion of the compressor 30 toward the outside, due to a height difference ($h_5$-$h_3$) between the height $h_5$ and the height $h_3$. That is, the draining element 180 is configured to tilt down from the central portion of the top cover 70 toward the bottom portion 160*b*. Note that the height difference ($h_5$-$h_3$) between the height $h_5$ and the height $h_3$ may be set to 5 mm or more.

As described above, the sound insulation element 190 of Embodiment 2 has the non-water-absorbent draining element 180 tilting down from the upper portion 160*d* toward the bottom portion 160*b*, together with the side cover 60 and the top cover 70. Therefore, also when condensed water W drops down from the refrigerant pipe 51 disposed above the compressor 30, the water can pass along an upper surface of the draining element 180 to be drained. Consequently, the condensed water W can be prevented from penetrating into a portion of felt of the sound insulation element 190. Therefore, a shell temperature sensor 35 disposed on an upper portion of the compressor 30 can be prevented from being wet with water or being submerged in water, so that false detection of the shell temperature sensor 35 can be inhibited. In addition, a compressor main body including a shell 30*a* can be inhibited from rusting, so that refrigerant can be prevented from leaking through holes made due to the rust in the compressor main body.

Furthermore, the side cover 160 has the suspending portion 160*c* disposed between two cuts of an upper end portion, and bent inwardly in the bottom portion 160*b* to be superimposed on the top cover 70, and the draining element 180 is disposed on the upper surface of the suspending portion 160*c*. Consequently, according to the sound insulation element 190, the draining element 180 can be stably disposed on the top cover 70 via the suspending portion 160*c*.

Additionally, the suspending portion 160*c* includes the inner surface fixing element 163 attached to at least a part of an inner surface of the suspending portion. The top cover 70 includes the upper surface fixing element 73 attached to a position facing the inner surface fixing element 163 in the upper surface of the top cover. Then, the upper surface fixing element 73 and the inner surface fixing element 163 are repeatedly attachable and detachable hook-and-loop fasteners that are affixed together. Therefore, the suspending portion 160*c* can be easily and stably attached to the top cover 70. In addition, a position of the draining element 180 can be easily adjusted by adjusting a position of the suspending portion 160*c* relative to the top cover 70, so that it is possible to improve convenience.

Furthermore, in the suspending portion 160*c*, the height $h_5$ of the highest point of the portion to be attached to the top cover 70 is higher than the height $h_3$ of the bottom portion 160*b*. Therefore, the draining element 180 can be securely inclined. In addition, two cuts of the upper end of the side cover 160 are formed at a position opposite to the terminal cover 31 relative to the central portion of the top cover 70. The height $h_3$ of the bottom portion 160*b* is lower than the height $h_4$ of the top cover 70 located on the upper surface of the terminal cover 31. Therefore, the draining element 180 can be easily inclined only by attaching the sound insulation element 190 to the compressor 30.

Additionally, in the sound insulation element 190 of Embodiment 2, the draining element 180 adopting such a structure as described above is disposed on the suspending portion 160*c* of the side cover 160, so that the condensed water W can be prevented from dropping down to the side cover 160 and the top cover 70 including a felt sheet. In addition, the sound insulation element 190 covers the side of the compressor 30 with the side cover 160, covers the upper surface of the compressor 30 with the top cover 70, and the covers the top cover 70 with the suspending portion 160*c* fixed to the draining element 180, thereby covering the whole compressor 30. Here, the side cover 160 and the top cover 70 comprise the felt sheet, so that noise of the compressor 30 can be reduced. That is, according to the sound insulation element 190 and the outdoor unit 10 of Embodiment 2, while a function of suppressing the noise of the compressor 30 is maintained, the condensed water W dropping down from a portion above the compressor 30 can be drained without penetrating into a portion of felt of the sound insulation element 190.

The other effects are similar to the effects of Embodiment 1. Additionally, the sheet portion 81 in the draining element 180 may have the base portion 81*a* fixed to the suspending portion 160*c* and the fixed portion 81*b* fixed to an outer peripheral surface 160*a* of the side cover 160 in the same manner as in Embodiment 1. In this case, the condensed water W can be more securely prevented from penetrating into the side cover 60. Furthermore, it has been described above that the inner surface fixing element 163 and the upper surface fixing element 73 are the hook-and-loop fasteners corresponding to each other, but the elements are not limited to this example. For example, the inner surface fixing element 163 and the upper surface fixing element 73 may be one or more sets of hooks corresponding to each other.

The above embodiments are suitable specific examples in a sound insulation element and an outdoor unit for an air-conditioning apparatus, and a technical scope of the present invention is not limited to these embodiments. For example, it has been described above that the sheet portion 81 is made of rubber, but a material for the sheet portion 81 is not limited to rubber, and may be made of another non-water-absorbent material such as a foam material. It has been described above that the guide portion 82 is made of the foam material, but the guide portion 82 is not limited to this example, and may be made of another non-water-absorbent material such as rubber. Furthermore, when the sheet portion 81 and the guide portion 82 are made of the same material, the draining element 80 may include the sheet portion 81 integrally formed with the guide portion 82.

Furthermore, the side covers 60 and 160 may be formed, for example, by laminating felt sheets made of felt, or rubber sheets made of rubber. Similarly, the top cover 70 may be formed, for example, by laminating felt sheets made of felt, or rubber sheets made of rubber. In addition, in the above drawings, an example is shown where four insertion holes 70*a* are disposed in the top cover 70, but the top cover is not limited thereto. The top cover 70 may include at least two insertion holes 70*a* so that the suction pipe 32 and the discharge pipe 33 are inserted into the insertion holes.

In Embodiment 1, the example has been illustrated where the base portion 81*a* is polygonal, but the shape of the base portion is not limited thereto, and may have a rounded outer periphery. For example, an outer periphery of a portion facing the bent portion 51*b* is not limited to such a V-shape as shown in FIG. 7, and may have a circular shape. That is, the shape of the base portion 81*a* can be appropriately changed in accordance with a shape of the refrigerant pipe 51 disposed above the compressor 30. Additionally, the sheet portion 81 may be laterally inverted for use, depending on the shape of the refrigerant pipe 51 above the compressor 30, However, the whole sheet portion 81 may be rectangular in the same manner as in Embodiment 2. Furthermore, the sheet portion 81 of Embodiment 2 is not limited to the rectangular shape, and can adopt various shapes in the same manner as in the sheet portion 81 of Embodiment 1.

In the above embodiments, the example has been illustrated where a highest position component present at the highest position among components constituting the compressor 30 (excluding the protruding components to be inserted into the insertion holes 70*a*) is the terminal cover 31, but the compressor is not limited thereto. That is, in the outdoor unit 10, the compressor 30 having the highest position component other than the terminal cover 31 may be mounted. In this case, a position of the cutout portion 61 and positions of two cuts in the upper end of the side cover 160 are determined on the basis of the highest position component. That is, in the outdoor unit 10, the top cover 70 is placed on the highest position component. Then, in Embodiment 1, the cutout portion 61 is disposed so as to face the highest position component relative to the central portion of the top cover 70. Furthermore, in Embodiment 2, the two cuts in the upper end of the side cover 160 are disposed opposite to the highest position component relative to the central portion of the top cover 70.

REFERENCE SIGNS LIST

1 top panel 2 front panel 3 back panel 4 bottom panel 5 service panel 6 sub panel 7 separator 8 base 10 outdoor unit 10A outdoor unit main body 20 indoor unit 30 compressor 30*a* shell 31 terminal cover 32 suction pipe 33 discharge pipe 35 shell temperature sensor 41 four-way valve 42 outdoor heat exchanger

42*a* outdoor fan 43 expansion valve 44 indoor heat exchanger

44*a* indoor fan 50 refrigerant circuit 51 refrigerant pipe 51*a* and 51*b* bent portion 60 and 160 side cover 60*a* and 160*a* outer peripheral surface

61 cutout portion 61*a* cut portion 61*b* bottom portion 63 side fixing element 70 top cover 70*a* insertion hole 70*b* cut 73 upper surface fixing element 80 and 180 draining element 81 and 181 sheet portion

81*a* base portion 81*b* fixed portion 81*r* water receiving portion 82 guide portion 83 draining side fixing element 90 and 190 sound insulation element 100 air-conditioning apparatus 160*b* bottom portion

160*c* suspending portion 160*d* upper portion 160*s* slit portion

163 inner surface fixing element H guide height R drainage path W condensed water

The invention claimed is:

1. An outdoor unit for an air-conditioning apparatus, comprising:

a compressor, a top cover configured to cover an upper surface of the compressor, a side cover configured to cover a side of the compressor and a side of the top cover, the side cover including a cutout portion formed in a part of an upper end of the side cover, and a non-water-absorbent draining element disposed across from a central portion of the top cover to a bottom portion of the cutout portion and continuously inclined downward from the central portion of the top cover to the bottom portion of the cutout portion.

2. The outdoor unit for the air-conditioning apparatus of claim 1, wherein the draining element has a sheet portion disposed on an upper surface of the top cover, and a guide portion disposed in a portion of a periphery in an upper surface of the sheet portion excluding the cutout portion.

3. The outdoor unit for the air-conditioning apparatus of claim 2, wherein the sheet portion has a base portion fixed to the top cover, and a fixed portion fixed to an outer peripheral surface of the side cover.

4. The outdoor unit for the air-conditioning apparatus of claim 3, wherein the fixed portion includes a draining side fixing element comprising a hook-and-loop fastener attached to at least a part of a lower surface of the fixed portion, and the side cover includes a side fixing element comprising a hook-and-loop fastener to be affixed to the draining side fixing element in a region facing the lower surface of the fixed portion in an outer peripheral surface of the side cover.

5. The outdoor unit for the air-conditioning apparatus of claim 2, comprising a refrigerant pipe connected to the compressor, wherein the refrigerant pipe includes a bent portion disposed above the compressor and bent downward, and the sheet portion is formed and disposed so that a portion inward of the guide portion in the upper surface of the sheet portion includes a position right under the bent portion.

6. The outdoor unit for the air-conditioning apparatus of claim 1, comprising a terminal cover protruding upward from the upper surface of the compressor, wherein the cutout portion is disposed at a position opposite to the terminal cover relative to the central portion of the top cover, the top cover is placed on an upper surface of the terminal cover, and the bottom portion of the cutout portion is formed at a position lower than the upper surface of the terminal cover.

7. An outdoor unit for an air-conditioning apparatus, comprising:

a compressor, a top cover configured to cover an upper surface of the compressor, a side cover configured to cover a side of the compressor and a side of the top cover, the side cover including two cuts along an up-and-down direction in an upper end portion of the side cover, and a non-water-absorbent draining element disposed across from an upper portion connecting upper ends of the two cuts to each other to a bottom portion connecting lower ends of the two cuts to each other, and tilts down from the upper portion toward the bottom portion.

8. The outdoor unit for the air-conditioning apparatus of claim 7, wherein the side cover has a suspending portion disposed between the two cuts and bent inwardly in the bottom portion to be superimposed on the top cover, and the draining element is disposed on an upper surface of the suspending portion.

9. The outdoor unit for the air-conditioning apparatus of claim 8, wherein the suspending portion includes an inner surface fixing element comprising a hook-and-loop fastener attached to at least a part of an inner surface of the suspending portion, and the top cover includes an upper surface fixing element comprising a hook-and-loop fastener attached to a position facing the inner surface fixing element in an upper surface of the top cover.

10. The outdoor unit for the air-conditioning apparatus of claim 8, wherein the draining element has a sheet portion disposed on an upper surface of the suspending portion, and a guide portion disposed on a peripheral portion in an upper surface of the sheet portion excluding the bottom portion.

11. The outdoor unit for the air-conditioning apparatus of claim 10, wherein the sheet portion has a base portion fixed to the suspending portion, and a fixed portion fixed to the outer peripheral surface of the side cover.

12. The outdoor unit for the air-conditioning apparatus of claim 10, comprising a refrigerant pipe connected to the compressor, wherein the refrigerant pipe includes a bent portion disposed above the compressor and bent downward, and the sheet portion is formed and disposed so that a portion inward of the guide portion in the upper surface of the sheet portion includes a position right under the bent portion of the refrigerant pipe.

13. The outdoor unit for the air-conditioning apparatus of claim 8, wherein a height of the highest point of a part of the suspending portion to be attached to the top cover is higher than a height of the bottom portion.

14. The outdoor unit for the air-conditioning apparatus of claim 7, comprising a terminal cover protruding upward from the upper surface of the compressor, wherein the two cuts are formed at a position opposite to the terminal cover relative to a central portion of the top cover, the top cover is placed on an upper surface of the terminal cover, and a height of the bottom portion is lower than a height of the top cover located on the upper surface of the terminal cover.

* * * * *